United States Patent [19]

Rees

[11] Patent Number: 5,030,962

[45] Date of Patent: Jul. 9, 1991

[54] ELECTROMAGNETIC RADIATION SENSOR

[75] Inventor: Huw D. Rees, Malvern, England

[73] Assignee: The Secretary of State for Defence in Her Majesty's Government of the United Kingdom of Great Britian and Northern Ireland of Whitehall, London, England

[21] Appl. No.: 314,693

[22] Filed: Feb. 3, 1989

Related U.S. Application Data

[63] Continuation-in-part of Ser. No. 357,080, Mar. 9, 1982.

[30] Foreign Application Priority Data

Mar. 11, 1981 [GB] United Kingdom ..... 8107622
Jul. 7, 1981 [GB] United Kingdom ..... 8121002

[51] Int. Cl.[5] ..... H01Q 15/08
[52] U.S. Cl. ..... 343/700 MS; 343/911 R
[58] Field of Search ..... 343/700 MS File, 785, 343/753, 909, 911 R

[56] References Cited

U.S. PATENT DOCUMENTS 3,373,425 3/1968 Barischoff .
3,781,896 12/1973 Toulis ..... 343/911 R
4,122,449 10/1978 Endo ..... 455/333
4,125,810 11/1978 Pavio ..... 455/327
4,331,957 5/1982 Enander et al. .
4,387,378 6/1983 Henderson ..... 342/374

*Primary Examiner*—Theodore M. Blum
*Attorney, Agent, or Firm*—Cushman, Darby & Cushman

[57] ABSTRACT

An electromagnetic radiation sensor for use at microwave frequencies comprises a sheet substrate bearing an array of dipolar antennas. The antennas have respective mixer diodes connected between adjacent dipole limbs, and the antenna array is located in the focal plane of a dielectric lens. Individual antenna center positions correspond to different beam directions for radiation incident on the lens, and the antenna center positions are in accordance with the Rayleigh resolved spot criterion. The dimensions, dielectric properties and relative positioning of the lens and substrate are such as to provide for the antennas to couple predominantly to radiation passing through the lens. The substrate thickness may lie between the lens and antenna array, or alternatively the array may lie between the substrtate and lens. In the latter case, the lens is of higher dielectric constant material than the substrate, at least in the lens region adjacent the array. The sensor of the invention provides a robust, low cost means of monitoring radiation directionally without requiring scanning means.

12 Claims, 10 Drawing Sheets

ELECTROMAGNETIC RADIATION SENSOR

This application is a continuation in part of application Ser. No. 357,080 filed Mar. 9, 1982.

TECHNICAL FIELD

This invention relates to an electromagnetic radiation sensor. More particularly, although not exclusively, it relates to a microwave sensor responsive to radiation of centimeter, millimeter or submillimeter wavelengths, i.e. frequencies of 3 to 30 GHz, 30 to 300 GHz and above 300 GHz respectively.

PRIOR ART

Radiation sensors are well known in the prior art. A rudimentary form of sensor is described in U.S. Pat. No. 4,331,957 (Reference 1). This discloses a radar transponder for locating buried avalanche victims. It consists of an antenna dipole incorporating two generally triangular plates connected together via a diode, this combination being embedded in a card of plastic. In use, the device is mounted on the outside of a skier's boot. The device responds to receipt of radiation of 0.915 GHz by re-emitting radiation at 1.83 GHz, the emission frequency being twice the received frequency by virtue of the nonlinear action of the diode connecting the antennas. A skier who has become an avalanche victim is located by a searcher employing a search transceiver transmitting 0.915 GHz and tuned to receive 1.83 GHz. The search transceiver is manually operated, and appears to be sensitive to a transponder located 15 meters away under avalanche snow. The transceiver/transponder combination is therefore an insensitive and very short range device, and the transceiver scan rate is merely that which the searcher can achieve manually. Since dipoles are substantially omnidirectional, the received signal is insensitive to antenna attitude and scanning provides little if any directional information.

U.S. Pat. No. 3,373,425 (Reference 2) describes a transponder similar to that of Reference 1, the major difference being that re-radiation is at the resonant frequency of an LCR circuit powered by radiation received by the transponder antenna. The device is intended for location of persons lost in desolate areas, and, as in the previous case, comparatively large signal power can be employed by a search transceiver to obtain a response. Insensitivity of the transponder is therefore not a critical problem for its envisaged uses.

It is estimated that antennas of the foregoing kind will capture only a small percentage of the search beam radiation in their vicinity.

A further radiation sensor is described in U.S. Pat. No. 4,122,449 (Reference 3). This is a transceiver device for measuring vehicle speed. It operates by emitting a microwave signal and detecting a Doppler-shifted return signal reflected from a moving vehicle. The transceiver consists of a waveguide coupled to a microwave circuit mounted on a ceramic plate. The circuit incorporates strip-lines coupling a microwave source to the waveguide and return signals from the waveguide to a microwave detector. The transceiver is a short range, handheld device with no provision for scanning other than manually. It is directionally insensitive. Its range would appear to be similar to that of Reference 3, i.e. the width of a city street. Furthermore, it illustrates the severe technical difficulties experienced in microwave apparatus construction. It incorporates transitions both to the waveguide from a strip-line power feed and from the waveguide to a branched or Y strip line connection to a detector. This is one of the many everpresent problems in microwave circuit engineering, i.e. the reliable implementation of transitions between different microwave transmission media. In practice, circuits incorporating such transitions do not work satisfactorily when first constructed, since the positioning of components is extremely critical. The circuits require manual adjustment by a skilled technician in order to function. Microwave engineers are all too familiar with this problem. Many hours of work may be needed, and the resulting device may not be functional in any event. The requirement for a substantial degree of manual adjustment of devices makes them highly unsuitable for mass production. Furthermore, this is in the context of a mere short-range device lacking both scanning means and directional sensitivity.

The problem of providing fast scanning, directional, long range radiation sensors has been addressed in for example the missile radar seeker field. U.S. Pat. No. 3,949,955 (Reference 4) relates to a typical monopulse radar receiver circuit for a missile designed to home on a radar emitter. This circuit incorporates four fixed antennas whose received signals are processed to provide a missile steering signal. Spiral antennas are illustrated, although it is also known to employ four reflecting dish antennas. The received signals are obtained from the radar emitter, and the antennas are not movable. More generally, missile seekers require antennas and processing circuitry similar to that of Reference 4, but the antennas must be arranged to scan to search for targets.

A scanning support mechanism for the antenna of a missile radar seeker is described in U.S. Pat. No. 4,199,762 (Reference 5). The mechanism consists of a support casting for the antenna assembly, the casting being mounted rotatably on a pitch shaft retained by a pitch pedestal. The antenna support casting incorporates a yaw torque motor assembly including two motors, a yaw potentiometer and yaw axis shafts. This casting also retains pitch, roll and yaw gyros for antenna attitude sensing and balance weights to balance the antenna about the pitch and yaw axes. The pitch pedestal contains a pitch potentiometer and a pitch torque motor driving the antenna pitch shaft via gears. The pitch and yaw shafts provide a gimballed mounting for the antennas, of which the yaw shafts provide the inner gimbal and the pitch shaft the outer. Prior to missile launch, the pitch and yaw potentiometers provide measurements to control antenna assembly position. After launch, the antenna-mounted gyros sense the antenna position and provide signals to activate the pitch and yaw motors. This stabilises the inertial attitude of the antenna.

The Reference 5 device exemplifies the design of antenna scanning systems incorporated in missile seekers. The antenna and its associated support, motors, gyros and balance weights are typically required to achieve scanning rates in excess of 1,000 degrees of arc per second. They must tolerate very severe G forces experienced by the missile during launch and subsequent manoeuvring. The antenna-mounted components, i.e. the yaw motors and pitch, roll and yaw gyros, must tolerate rapid movement and acceleration as the missile moves and the antenna scans relative to the missile. Furthermore, signals from the antenna must be fed through flexible connections (not rigid waveguides)

from the scanning antenna support to signal processing circuitry which is relatively static in the missile. At microwave frequencies, this leads to cable chafing and signal transmission variation as cables flex.

Scanning antenna systems such as that of Reference 5 are a triumph of the mechanical engineering art. They are highly complex, extremely accurate devices which achieve good performance under severe conditions. However, they are comparatively bulky and expensive. Moreover, their sensitivity is restricted at any instant to objects within the radar beam of the antenna. The antenna scanning function is required to extend sensitivity to cover a much wider area. The antenna can detect radar reflections from objects distant may kilometers, provided that any such object passes through the scanning beam. Achievable scan rates are however too slow to ensure that all possibly fast-moving objects passing through the antenna scan region are detected. Furthermore, the requirement to incorporate gyros and motors in the scanning antenna system imposes a severe restriction on aerodynamic design, since missile agility is limited to that which the gyros can tolerate.

Scanning radar systems are also known which employ ground-based rotating antennas. Such a system operating at 3 GHz (S band) typically comprises a rotating antenna in the form of an elliptical dish 13 meters wide by 6 meters deep and weighing in the region of several tons. It may be a transmitter, or a receiver or both. In either case it is employed to scan a scene in two dimensions, elevation and azimuth. The azimuth scanning function requires a large and expensive servo motor to rotate the antenna, which provides a scan rotation period several seconds long.

In addition to cost and bulk disadvantages, a conventional radar system suffers from serious limitations in use. The distribution of power over the surveillance volume is invariant. For two dimensional scanning, the elevation coverage is a compromise because of the difficulty of producing a fan-shaped beam. This results in loss of performance at both low and high angles. At low angles near the horizon loss of performance is particularly undesirable, since it reduces detection capability for low, fast-moving targets. Conventional radar also has a fixed dwell time or time for which a given scene region is scanned. The dwell time depends solely on the antenna rotation period and the azimuth beamwidth. Furthermore, the data rate is fixed. It is a compromise between the conflicting requirements of general scene surveillance (low data rate) and target tracking (high data rate). This compromise is unsatisfactory, and a combination of a surveillance radar with a plurality of dedicated target trackers is necessary for good performance.

To overcome the deficiencies of conventional mechanically scanned radar, phased array radar has been under consideration and development for twenty or more years. A two-dimensional array of radar antenna elements is employed, generally but not necessarily a planar array. The array "look direction⇄ is steered by varying the phasing of individual radar frequency (RF) or local oscillator (LO) signals supplied to array elements in the transmit and receive modes respectively. A plane radar wave parallel to a planar phased array, i.e. travelling along the array boresight direction, is received by all array elements in phase. If all array elements receive the same LO signal phase, they will produce like intermediate frequency (IF) signals. A plane wave travelling at an angle to the array boresight direction will develop like IF signals if the LO phase varies linearly across the array in a fashion which corresponds to that of the incident wave. In other words, varying the LO phase across the receive array steers the array look direction. In an analogous fashion, phase variation of the RF drive signals across an array of transmitting elements alters the array output direction.

The major advantage of phased array radar is that the beam is inertialess. It is steered electronically, not mechanically. There are no mechanical limitations on beam steering, such as the accelerations and speeds to which gyros and servo motors are restricted. There is no need for flexible connections between antenna and processing circuits to accommodate antenna motion. In addition to these design aspects, phased arrays possess the following performance capabilities not possessed by conventional equivalents:

(1) Power distribution is variable to concentrate on directions of special interest.
(2) Surveillance and tracking functions are decoupled from one another.
(3) Dwell time and data rate are variable as a function of angle.
(4) Data rate may be adaptive.
(5) Power required for surveillance is reduced.
(6) Clutter suppression is improved.
(7) Target classification is facilitated.
(8) Multifunction capability: one phased array may replace a combination of a surveillance radar and a plurality of target trackers.

Despite the known manifold advantages of phased arrays, and their investigation for many years, their development and implementation have been very slow indeed. This is because the engineering design problems are formidable, and the costs involved in surmounting them prohibitive for most applications.

A phased array radar is described in Scientific American, Vol. 352, February 1985, pages 76–84, page 77 in particular (Reference 6). It is the Pave Paws radar located at Otis Air Force Base, Cape Cod, U.S.A. This installation comprises two phased arrays each incorporating 1,792 radiating elements on a 102 ft. wide face. The arrays face in directions 120 degrees apart and are mounted on the walls of a building approximately 100 ft. high. This radar system has a range of 3,000 nautical miles. It is capable of shifting its beam direction in microseconds, and has a 240 degree field of view. Against this, it is of enormous dimensions and expense. The phased arrays and their supporting edifice have a volume in the order of half a million cubic feet. Although the article does not mention cost, phased array radars of this kind are known to cost many tens of millions of dollars or more.

A further phased array radar known as MESAR has been described in the conference RADAR-87, London, England 19–21 October 1987 (Reference 7). It comprises a single array of nine hundred and eighteen waveguide radiating elements arranged in a square of side six feet. A viable phased array based on this construction having four faces and fifteen hundred elements per face is estimated to cost in the order of three million dollars.

An antenna array is also described in U.S. Pat. No. 3,781,896 (Reference 8). It comprises individual antenna dipoles engulfed (i.e. encapsulated) in dielectric material. The dielectric material may be a lens within which all the antennas are disposed and arranged to form a curved array. Alternatively, each antenna may be encapsulated within a respective dielectric lens material to form a building block for the construction of a lens-engulfed antenna array consisting of a number of individual blocks assembled together. Reference 8 is however entirely silent regarding feeding of signals to and from the antenna array, and more importantly regarding measuring received signal direction. There is no indication as to whether another antenna is to be employed to radiate signals to the lens-engulfed array, or alternatively whether or not signal feeds are to be furnished through the engulfing lens material to each antenna. These are major technological issues governing sensitivity, cost, weight, bulk, and suitability for mass production. In particular, as a matter of microwave engineering, it would be a major problem to provide radar signal feeds to or from every lens-engulfed antenna, since this would involve many waveguide-engulfed antenna transitions with consequent reflections. Moreover, to implement beam steering, Reference 8 would require either a movable primary antenna to provide signals to the engulfed antennas or local oscillator signals differing in phase to be applied to the engulfed antenna signals. Neither of these is disclosed.

It is an object of the present invention to provide an alternative form of electromagnetic radiation sensor which is capable of providing radiation intensity as a function of scene position, and which is suitable for mass production at low cost.

The present invention provides an electromagnetic sensor of modular construction including:

(a) a substrate module in the form of a sheet and retaining:
  (i) an array of antennas each having at least two dipole limbs supported by a substrate sheet surface,
  (ii) a respective mixing means for each antenna, the mixing means comprising at least one high frequency mixer diode connected between two antenna limbs,
  (iii) means for relaying low frequency signals developed by the mixing means to sensor outputs, (b) a dielectric lens module assembled together with and closely adjacent to the substrate to transmit radiation incident on the lens to the antenna array, the lens being configured such that the antenna centre positions in the array correspond to differing beam directions for radiation incident on the lens, and the lens-antenna array spacing and the lens and substrate dimensions and dielectric properties being in combination such as to provide for each antenna to couple predominantly to radiation passing through the lens.

Each antenna necessarily has a radiation pattern or beam which may overlap one or more other such patterns depending on the array positioning with respect to the lens focal plane and the spacing between neighbouring antennas. However, each antenna responds to incident radiation received over a respective angular disposed about a respective beam centre line located in accordance with antenna position in the array. Each antenna therefore responds to radiation from its own scene region, which may overlap those of other antennas. Each antenna's mixing means consequently develops a respective unique signal corresponding to its array position and radiation pattern projected on to the scene through the dielectric lens. Consequently, the array of antennas generates the microwave equivalent of individual pixel signals in an optical camera. Where there is significant overlap between antenna radiation patterns, the required far field radiation pattern or scene may be determined by combining signals during processing of sensor outputs.

The invention provides a number of important advantages over the prior art previously discussed. Firstly, it provides information on the spatial variation of radiation in a scene without requiring manual, mechanical or electronic scanning, unlike References 3, 5 and 6 respectively. In particular, it provides simultaneous spatial coverage, whereas mechanically scanned devices are sensitive in only one direction at any instant. The invention has no moving parts, unlike Reference 5, and no requirement for electronic phase shift varying across an antenna array, unlike phased array radars. Secondly, by virtue of its modular construction, it is extremely cheap to manufacture and is highly suitable for mass production. Thirdly, it can easily be manufactured in a rugged form suitable for high acceleration environments. Fourthly, it is capable of very high sensitivity. Embodiments of the invention have been manufactured in which the antenna array captures 70% of the radiation incident on the dielectric lens. Such embodiments are suitable for detecting objects at ranges in the order of kilometers or more. Fifthly, the substrate module with its microwave circuit components, i.e. the substrate, antennas, mixing means and low frequency relaying means, can be manufactured by mature printed circuit and/or integrated circuit technologies separately from the lens. This advantage arises because the antennas and associated circuitry are sheet-mounted and therefore highly suited to these technologies, which are easily capable of accurate replication of a microwave circuit design at low cost. Sixthly, since the mixing means is connected directly to antenna limbs, immediate down-conversion to low frequency is obtained. Consequently, there are no manual adjustment problems with transitions between waveguides and strip lines for example. It is estimated that the substrate module and the lens module would cost in the region of 1,000 dollars or less in mass production. More generally, manufacturing costs are less than one tenth that of prior art devices with comparable performance. Finally, the invention is characterised by much smaller size and weight than equivalent prior art devices. The substrate module with its microwave circuit components need be no larger than a small printed circuit or an integrated circuit, and the dielectric lens module need only be sufficiently large to overlie the antenna array.

Prior art microwave sensors such as radar receivers commonly incorporate reflecting dish antennas to gather radiation for detection. Simple dipole antennas lacking such reflectors (e.g. References 1 and 2) are far too insensitive for most applications. However, in accordance with the invention it has surprisingly been discovered than an array of dipole antennas can in fact provide high reception sensitivity when combined with an adjacent dielectric lens, since the lens imposes one-sided and directional radiation coupling on each antenna. The lens may couple radiation to the antenna array through the substrate thickness, in which case the lens and substrate may have similar dielectric properties. For example, an alumina lens ($E \approx 10$) may be employed with a silicon substrate ($\epsilon \approx 12$). In this case, the substrate acts as an extension of the lens. The lens may also be of lower dielectric constant than the substrate, in which case the substrate should be thin and/or have comparatively high conductivity to inhibit trapping of radiation in it. Alternatively, the lens and substrate may be arranged so that the antenna array is sandwiched between them. In this case, the dielectric lens has significantly higher dielectric constant material so that radiation coupling to the antenna array is predominantly via the lens. Barium nonatitanate ceramic ($Ba_2Ti_9O_{20}$) is a suitable lens material for this embodiment, having a dielectric constant of 39 approximately.

The antenna array may be located at a position displaced from the focal plane of the lens. This produces the effect that radiation from a particular direction is received by more than one antenna, although low frequency output signals will differ. The output signals may then be processed to derive the direction of the incident radiation. In a preferred embodiment, however, the antenna array is located in or near the lens focal plane; i.e., the array is located within the lens depth of focus so that each antenna receives a respective resolved beam of the lens. In this embodiment, the antenna spacing is preferably in accordance with the Rayleigh resolved spot separation criterion. This criterion strikes a balance between the conflicting requirements of close antenna spacing to maximise radiation capture and wide antenna spacing to enhance resolution.

The invention may incorporate means for relaying a local oscillator (LO) signal to the antenna array in order to enhance sensitivity. As is well known in signal processing, a mixer employed without an LO rectifies a high frequency signal to provide an output proportional to the square of the signal. With an LO, the mixer output is directly proportional to the signal, and this is fundamentally a more sensitive arrangement for detection of small signals. It is however important to note that there is no requirement for the antennas to receive differing LO phases to provide electronic beam steering as in a phased array.

The substrate may be of semiconductor material—for example silicon (Si)—or, gallium arsenide (GaAs). Alternatively, to facilitate the design of co-operative low frequency integrated circuitry, the substrate may be of dielectric material, or high resistivity semiconductor material, having one or more thin layers of relatively low resistivity semiconductor material on its upper surface. Each layer may be an epitaxial layer grown on the substrate surface.

The antenna array may be in direct contact with the upper surface of the substrate, and be formed directly on semiconductor material. Preferably, however, the array spaced from semiconductor material by a layer of dielectric material, in order to protect the semiconductor surface and to avoid the formation of undesirable metal-semiconductor compounds.

Each antenna may have two dipole limbs only. Each limb may be shaped as a narrow or wide strip, or may have a fanned out shape according to application. In this embodiment, each mixing means may comprise a single ended mixer consisting of one or more diodes. The low frequency signal conducting means may comprise a transmission line formed of two parallel strips, each strip being co-extensive with, and extending orthogonal to a corresponding one of the antenna limbs.

Each antenna may have four limbs, each pair of opposite limbs being arranged in the form of a dipole, with adjacent limbs orthogonal to each other. This antenna configuration may comprise mixing means in the form of a ring of diodes arranged as a balanced mixer. In this embodiment, the diodes are arranged head to tail around the ring, and each diode is connected across a pair of adjacent limbs; the low frequency signal conducting means may incorporate a pair of conductive channels embodied in the substrate, and each channel may be connected to a corresponding one of two adjacent limbs. One or more of the antenna limbs may alternatively be split along its length to define the conducting means, the diodes being arranged around the ring so that a split antenna limb acts as a mixer output transmission line.

Alternatively, each four-limb antenna may be associated with a respective coherent mixing means comprising a diode ring including a transmission line connecting pairs of diodes. In this embodiment, the transmission line extends between and forms a dipole in combination with upper and lower limbs of the antenna; the transmission line has an electrical length of one-quarter wavelength at the signal frequency.

In a preferred construction of the invention, each four-limb antenna has two side limbs which are both split along their length into upper and lower branches. The side limbs provide respective low frequency signal conducting means for in-phase and quadrature mixer output signals.

It is convenient to combine the sensor of the invention with a respective low frequency amplifier circuit for each antenna, the amplifier being embodied and integrated in the substrate. Embodiments of the invention having low frequency signal conducting means implemented as a transmission line or as a split antenna limb may embody these amplifiers in the underlying region of the semiconductor within the substrate. In this region the high frequency electric field parallel to the semiconductor surface is weak. In this form, the invention is particularly compact and self-contained. Multiplex circuitry may be integrated with each amplifier to facilitate signal processing and access.

BRIEF DESCRIPTION OF THE DRAWINGS

Examples of the invention will now be described with reference to the accompanying drawings of which.

DESCRIPTION OF EMBODIMENTS OF THE INVENTION

Figure 1:
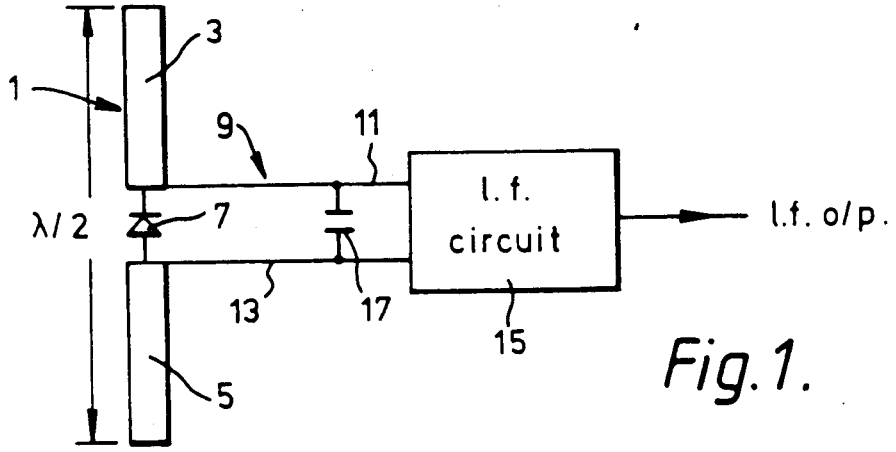
FIG. 1 is a schematic diagram of an antenna circuit for sensor of the invention.

The sensor shown in FIG. 1 comprises a narrow strip metal dipole antenna 1 having an upper limb 3 and a lower limb 5. This metal antenna 1 lies on the upper surface of a high resistivity supporting substrate and the two limbs 3, 5 of this antenna 1 are spaced apart at the dipole centre and interconnected by a single-ended mixer, a Schottky-barrier mixer diode, 7, embodied in between the limbs 3, 5 in the upper surface of the substrate. Connected across this diode 7 and extending from the two antenna limbs 3, 5 in a direction orthogonal to the dipole axis of the antenna is a transmission line 9 formed of two parallel extension branches 11, 13 also of narrow metal strip.

This transmission line 9 provides a means to relay low frequency response signal, i.e., signal developed across the diode 7 when radiation of appropriate frequency is received by the antenna 1 and mixed by the diode 7. This transmission line 9 is connected, at points remote from the antenna 1, across the input of a low frequency (1f) circuit 15, adjacent to the sensor, a circuit integrated and embodied in the upper surface of the substrate.

The length and width of the antenna 1 are both chosen so that the antenna 1 is suitable for receiving radiation having a frequency lying in the 25 to 500 GHz range. The antenna 1 shown is chosen to have a length equal to one-half wavelength for radiation of 100 GHz frequency. This length is governed by the antenna geometry, the dielectric constant $\epsilon$ of the supporting substrate, and the dielectric constant $\epsilon'$ of the ambient medium, air ($\epsilon'=1$). Detailed calculation shows that the resonant length of a supported antenna is inversely proportional to a scaling factor $\bar{n}$, and that the antenna admittance is directly proportional to this scaling factor $\bar{n}$, the factor $\bar{n}$ being to a good approximation independent of the antenna geometry and related to the media constants by the formula:

$$n=\sqrt{(\epsilon+1)/2}$$

i.e., the square root of the average of the dielectric constants of the two media, one of which is air in the present embodiment. In the example, the substrate is of silicon semiconductor material ($\epsilon \simeq 11.7$). The scaling factor $\bar{n}$ thus has a value 2.5 approximately and the length of the antenna 1, one-half wavelength ($\lambda/2$) at a resonant frequency of 100 GHz, is calculated to be 600 $\mu$m approximately. For an antenna width of 10% of the antenna length, the resonance is calculated to extend from about 0.75 to 1.1 times the half wavelength frequency, so an antenna of length 600 $\mu$m and width 60 $\mu$m is suitable for frequencies from 75 to 110 GHz.

The transmission line 9 is designed to have an electrical length of approximately one-quarter wavelength ($\lambda/4$) at the resonant frequency. This length, approximately 300 $\mu$m, it is noted, may differ marginally from the value of one-quarter wavelength calculated for the antenna, for here in the propagation mode the high frequency current flow in the two branches 11 and 13 of the transmission line 9 is that of two equal magnitude components flowing in opposite directions. A shunt capacitance 17, across the transmission line 9, is included to ensure that a reactive impedance of high value, effectively open circuit, is presented across the diode 7. The transmission line 9 thus provides an output port effectively isolated from high frequency, to relay low frequency currents developed across the diode 7 to the lf circuit 15. The width of the transmission line 9 is chosen to be small $<50$ $\mu$m and it is arranged orthogonal to the antenna 1 to ensure that the line 9 interferes to minimal degree with the action of the antenna 1.

Alternatively, the transmission line 9 may be designed as a periodic line having a suitable top band.

The lf circuit 15 includes an integrated preamplifier stage with grounded emitter or grounded base transistor input and may also include more advanced circuit components e.g. time multiplex components.

Figure 2:
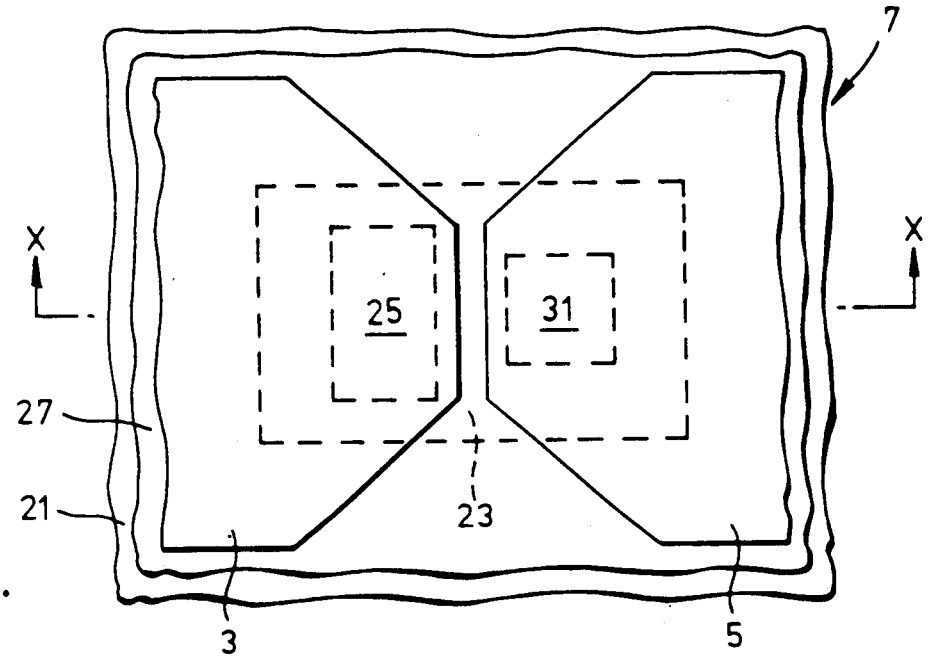
FIG. 2 is a more detailed plan drawing of the mixer shown in FIG. 1.
Figure 3:
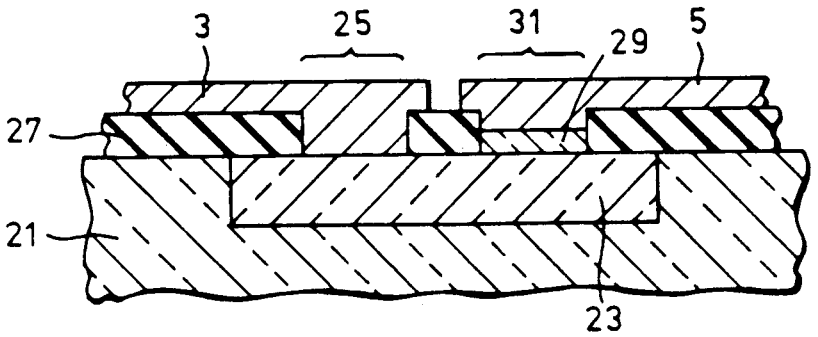
FIG. 3 is a cross-section through lines X—X in FIG. 2.

The construction of the mixer part of the sensor 1 is shown in detail in FIGS. 2 and 3 of the drawings. The mixer consists of a Schottky diode 7 embodied in the silicon material of the substrate 21. This silicon material is of readily high resistivity, having in this example a value in excess of 100 ohm cm. This is chosen to minimise the attenuation of input radiation travelling through from the underside of the substrate.

It is noted that an antenna supported on a substrate ($\epsilon >> 1$) couples predominantly to radiation in the medium of higher dielectric constant, i.e. into the substrate.

The attenuation loss is given approximately by the ratio ($Z/\rho_s$), where Z is the characteristic impedance for radiation propagating through the substrate, $\rho_s$ the sheet resistivity. For the silicon substrate ($Z \simeq 100\ \Omega$) which is here of nominal thickness 400 $\mu$m, a resistivity of 100 ohm cm corresponds to an attentuation loss of approximately 5%, an acceptable value. The antenna impedance and radiation polar diagram are also sensitive to the substrate resistivity, but for the antenna described above the effect is small for a substrate resistivity of 100 $\Omega$ centimeter or more.

The substrate 21 includes a region 23 of excess doped $n^+$-silicon formed by diffusion or other technique—e.g. by implantation. An ohmic contact is made between the metal of one of the antenna limbs 3 and this $n^+$ region 23 through a window 25 in an insulating layer 27 of silicon oxide dielectric material interposed between the limbs 3 and 5 and the substrate 21. An n-type silicon region 29 in another window 31 in the insulating layer 27 joins the $n^+$ region 23 and the other antenna limb 5 forms a Schotty barrier contact on the upper side of the n-type region 29. The diode dimensions are approximately 10 $\mu$m square overall, most of the diode area being taken up by the ohmic metal semiconductor contact 3/23. The diameter of the barrier contact is chosen so that the diode impedance is matched to the resonant impedance ($\simeq 25\ \Omega$) of the antenna 1. The diameter is not critical, typical values being 5 $\mu$m at 25 GHz decreasing with frequency to about 1 $\mu$m at 500 GHz.

Figure 4:
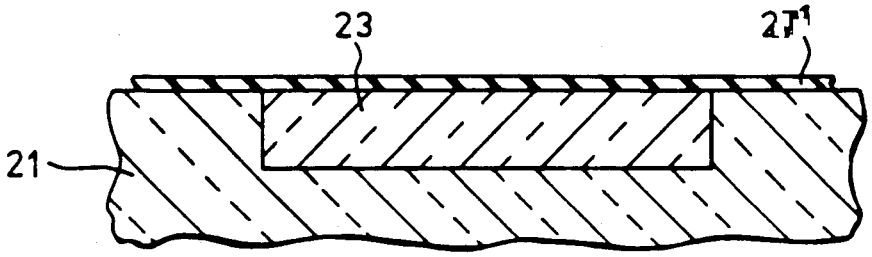
FIGS. 4 to 7 are cross-sectional drawings showing stages in fabrication of the FIG. 2 mixer.
Figure 5:
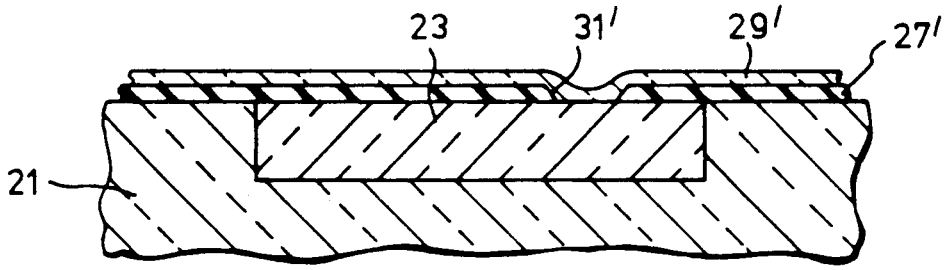

The monolithic antenna-diode sensor may be fabricated by conventional semiconductor processing, for example as shown in FIGS. 4 to 7. A substrate 21 of silicon is provided, an $n^+$ type diffusion region 23 is produced and a layer of oxide 27' thermally grown over the substrate surfaces (FIG. 4). A window region 31' is then defined in the oxide layer 27' by photolithography followed by an etch. After the exposed surfaces have been cleaned, a layer of n-type silicon 29' is then grown epitaxially so to produce a layer over the $n^+$ *type region* 23 *exposed through the window* 31' *of the oxide layer* 27' (*FIG.* 5).

Figure 6:
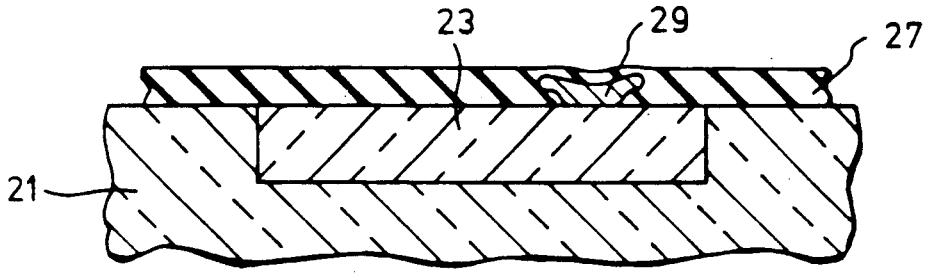
Figure 7:
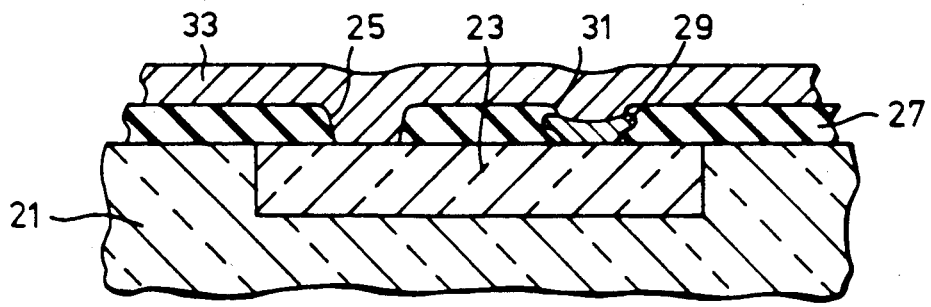

Photolithography and etching removes most of the layer 29', leaving only the region 29 in and just around the window 31'. Silicon oxide is deposited over the exposed surface of the substrate 21 covering the barrier region and forming a thicker oxide layer 23 over the rest of the surface (FIG. 6). Windows 25 and 31 are then photolithographically defined and etched through the oxide layer 27 and metal evaporated on to the surface of the substrate to form a layer 33, forming an ohmic contact through one window 25 and a barrier contact through the other window 31 (FIG. 7). The antenna limbs 3, 5 and transmission line arms 11, 13 are then photolithographically defined and left when excess metal has been etched away from the metal layer 33.

Alternatively, window 31 may be etched before window 25 and a metal, such as titanium, nickel or chromium, which makes a good Schottky barrier contact to n-type silicon is evaporated over. This metal is photolithographically defined and etched, leaving it in and just around the window 31. Window 25 is then defined and etched, a top layer of metal is evaporated over and the antenna limbs 3, 5 and transmission line arms 11, 13 are then defined and etched.

The monolithic integration of antenna and mixer can be extended to more complex configurations. Thus the mixer can be configured as a balanced mixer (FIGS. 8, 9 and 10) or, with somewhat more complexity, as a coherent mixer (FIGS. 11 to 15). It is a property of these mixers that the lf response, developed, is a null when only radiation of polarisation parallel to one pair of antenna limbs is received. This has the practical advantage of relative insensitivity to local oscillator amplitude fluctuations, i.e. to amplitude noise of the local oscillator. A signal is produced when this radiation is mixed with signal radiation of orthogonal polarisation.

Figure 8:
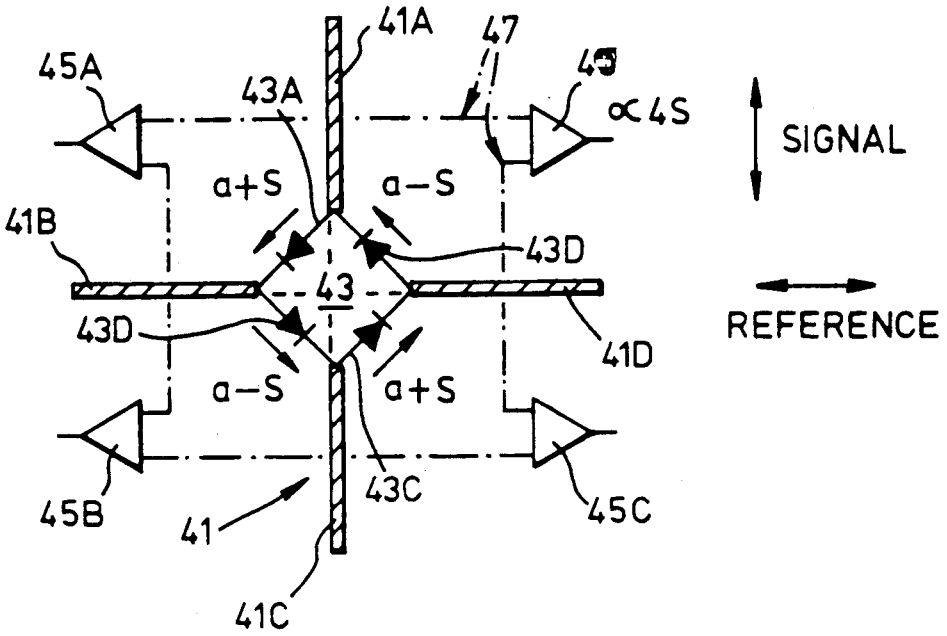
FIG. 8 is a schematic diagram of an alternative antenna circuit including a balanced mixer.

The sensor shown in FIG. 8 comprises a four-limb antenna 41 on a silicon substrate, the limbs 41A to 41D of the antenna 41 being interconnected by a balanced mixer 43 formed of a ring of Schottky diodes 43A to 43D, the diodes being arranged in head to tail order about this ring. Pairs of opposite limbs 41A and 41C, 41B and 41D, each form a dipole and these dipoles are arranged to be orthogonal to receive radiation, signal and reference, of orthogonal polarisation e.g. vertical and horizontal polarisation as shown. To ensure correct current phasing in the sensor, it is important that the diodes 43A to 43D are arranged symmetrically with respect to the antenna limbs 41A to 41D. For a phase error of $\pm 1\%$ of $2\pi$ radians at 100 GHz, this implies a positional tolerance of about $\pm 10\ \mu m$.

The current flow pattern developed in the sensor can be represented by equivalent short circuit currents of amplitude a $\pm$ s through each diode, "a" being a current component due to rectification of the local oscillator alone and "s" being the current component arising from the mixing of the reference and signal. The ring arrangement provides a natural short circuit path for the rectified local oscillator current "a" (i.e. in the absence of signal radiation, the voltage across each diode is zero). The mixed current component "s", representing the response signal, however, may be extracted from any pair of adjacent limbs (e.g. 41A to 41D), and taken to a preamplifier circuit integrated in the substrate (e.g. circuit 45) via connections 47.

In principle greater sensitivity may be obtained by combining the low frequency signals from all four diodes. One way is to fabricate connections across the mixer ring, i.e. from limb 41A to limb 41C and from limb 41B to limb 41D. Alternatively, an amplifier could be connected across each diode and the signals combined after amplification. These amplifiers are numbered 45, 45A, 45B and 45C in FIG. 8. However in all cases the low frequency connections to the amplifier or amplifiers, or connections across the mixer ring, need to be made in such a way that the high frequency currents are not modified or dissipated to an unacceptable degree. The connections cannot be metallic since this would distort the antenna action. They may be made of resistive material such as doped semiconductor, but in this case the sheet resistivity must be high enough to give minimal absorption of high frequency signals. Calculations show that the sheet resistivity should exceed about 300 $\Omega$ per square and the total resistance of each connection must greatly exceed the antenna impedance on resonance, which is typically 25 $\Omega$. High sheet resistivity is particularly important close to the antenna metal where the fringing electric fields are highest. For minimal dissipation of the high frequency power the resistance of each connection needs to exceed a figure of the order $10^3\ \Omega$ and this series resistance will degrade the signal/noise ratio of the mixer and amplifier. For applications needing optimum signal/noise this would not be acceptable, but for applications tolerating reduced sensitivity, this approach may be used.

An alternative arrangement for the lf output port, eliminating the resistive connection to the low frequency amplifier, results from splitting one or more of the antenna limbs 41A to 41D. Each split limb comprises a pair of closely spaced metal conductors and functions as a low impedance transmission line, so that the hf voltage across each pair of conductors is low. In effect, the split limbs are shorted at hf but isolated at lf. The hf impedance between the conductors may be further reduced by increasing the capacitance between them. One method is to form small regions of highly doped semiconductor extending under both metal conductors but dc isolated from the metal by the oxide layer. Alternatively a dielectric layer may be deposited over the metal and a further metal layer overlaid on the dielectric. One opposite pair of diodes is reversed relative to the configuration shown in FIG. 8 and the lf signal output can be extracted between the pair of conductors forming one of the limbs.

Figure 9:
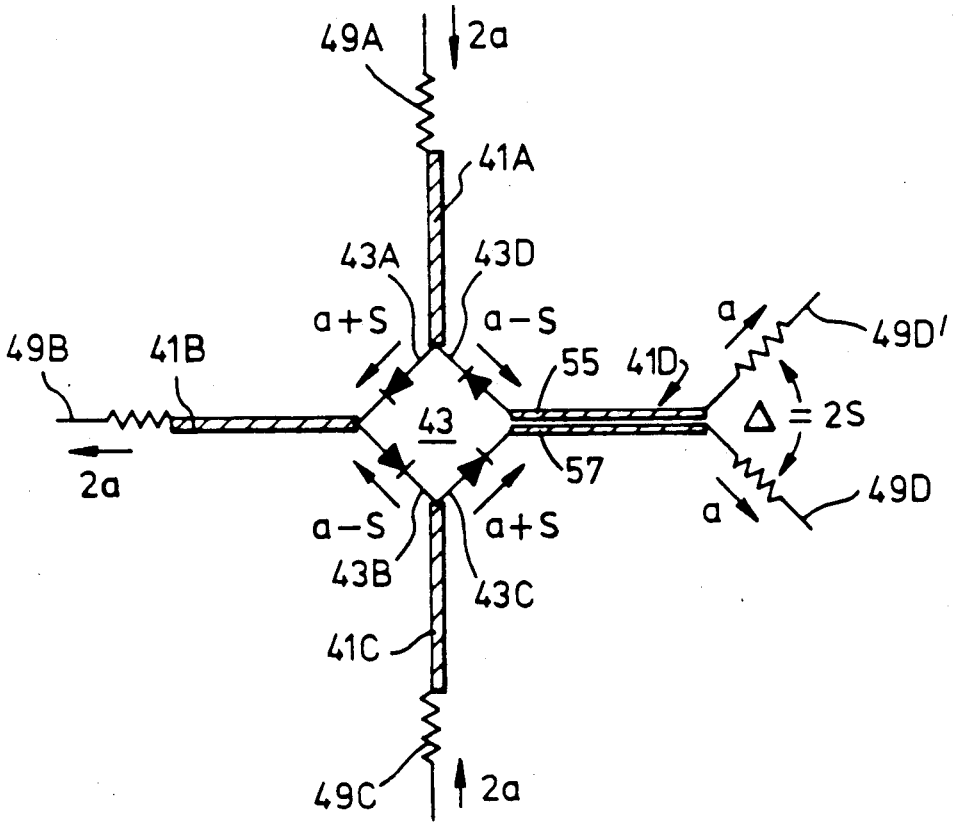
FIG. 9 is a schematic diagram of a modified version of the circuit shown in FIG. 8.

In the example shown in FIG. 9 the limb 41D is split, with the two diodes 43B and 43D reversed, and the output is extracted across the two branches of this limb 41D, the two parallel conductors 55 and 57 shown in FIG. 9. A low frequency amplifier can be connected between these metal conductors 55 and 57 without the need for non-metallic resistive connections 47, and therefore without consequent sensitivity penalty. It is convenient to situate the low frequency amplifier beneath the metal forming the split limb 41D because the high frequency electric field is weak and the presence of the amplifier components, such as transistors, does not significantly modify the antenna action.

The amplifier may be isolated from the metal at low frequency by an oxide layer where necessary. Power supplies and output connections for the amplifier need to be through resistive links, but this involves very little degradation of the overall signal/noise ratio and modest power dissipation. The dc currents through the diodes 43A to 43D cannot flow around the diode ring because it no longer has a head to tail configuration. Instead the currents need to be taken through external circuits, but these can be made resistive without degrading the receiver sensitivity. Resistive connections 49A to 49D and 49D' for diode biassing, are provided at the end of each of the limbs 41A to 41D as shown in FIG. 9.

Figure 10:
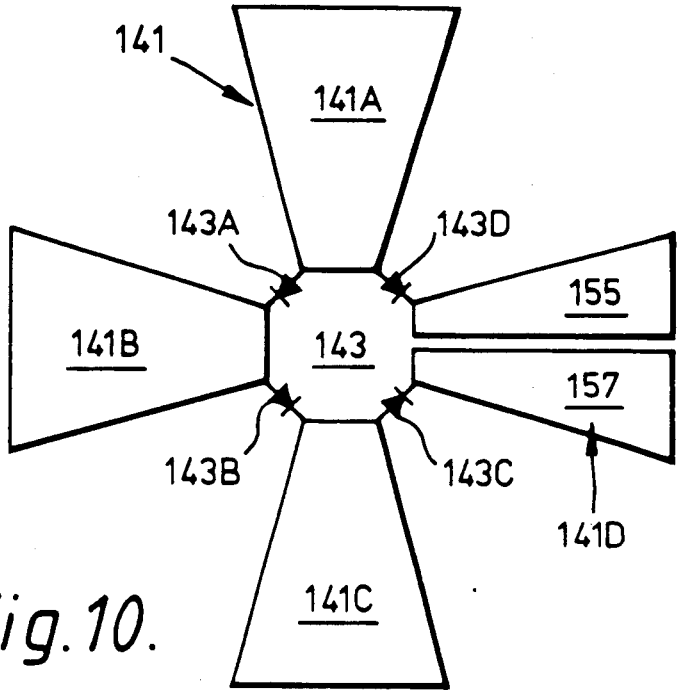
FIG. 10 is a plan drawing of a modified version of the circuit shown in FIG. 9.

The antenna limbs need not have rectangular configurations. An alternative geometry is obtained by widening the metal away from the antenna centre. Thus as shown in FIG. 10 the antenna comprises four limbs 141A to 141D each of wedge shape. The side limb 141D is split into half portions 155 and 157 as in FIG. 9 preceding, these limbs 141A to 141D are interconnected by a ring of diodes 143A to 143D. These are arranged as the diodes in FIG. 9 and the whole behave as a balanced mixer. Calculations show that the resonant frequency of the antenna is slightly reduced and the admittance slightly increased by this change of shape. The widened antenna allows a greater area for low frequency integrated circuit components underneath the metal.

An alternative diode and antenna arrangement is shown in FIGS. 11 to 14. The antenna 241 shown has two side limbs 241B and 241D and extending traverse to these in the orthogonal direction, an upper limb 241A and a lower limb 241C. The side limbs 241B and 241D together form a dipole of chosen length $\lambda/2$ and each is split along its length. It is necessary for each split limb to act as a single conducting element at high frequency and it can be advantageous to increase the capacitance between the parts of the split limbs such as by the techniques already described for the split limbs of the balanced mixer of FIG. 9. The upper and lower limbs 241A and 241C together with a partitioned strip of metal 261 extending in between these limbs 241A and 241C, form a modified dipole, also of chosen length $\lambda/2$.

Figure 12:
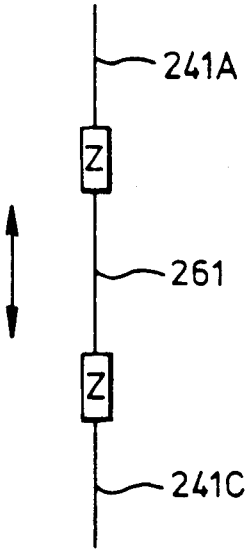
FIGS. 11, 12 and 13 are circuit diagrams.
Figure 13:
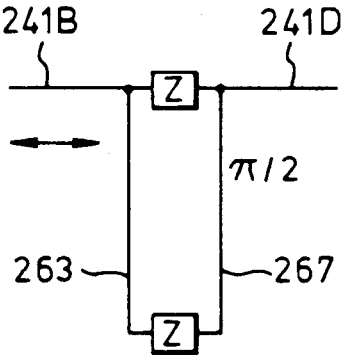

The upper and lower limbs are each chosen of equal length approximately $\lambda/8$, and the partitioned strip 261 is of length $\lambda/4$, i.e. of length one-quarter wavelength corresponding to the resonant frequency of the dipole formed by the side limbs 241B and 241D of the antenna 241. The split limbs 241B and 241D have upper and lower branches 251 and 253, 255 and 257 respectively. The partitioned strip of metal 261 is composed of three parallel conductors 263, 265 and 267. The outermost narrow conductors 263 and 267 are co-extensive with and orthogonal to the lower branches 253 and 257 of the slide limbs 241B and 241D. The three conductors 263, 265 and 267 complete the dipole formed by the limbs 241A, 241C of the antenna 241, and also function as a transmission line $\lambda/4$ long connected across the side limbs 241B and 241D. For radiation of vertical polarisation as shown, no transverse electromagnetic (TEM) mode of the transmission line 261 is excited and the tow pairs of diodes 243A, 243D and 243B, 243C act as loads Z symmetrically placed on the antenna 241 (FIG. 12). The radiation couples to an antenna mode in which the load currents are equal. For radiation of horizontal polarisation as shown, the transmission line introduces a phase shift of $\pi/2$ between the signals at the lower and upper loads Z. The third and middle conductor 265 extends from the upper branch 251 of one of the side limbs 241B to the lower end of the partition strip 261 where it is connected to the outermost conductor 267. This middle conductor 265 provides a low frequency connection to the lower branch 257 of the other side limb 241B. This allows a re-distribution of the low frequency current flowing in the side limbs and serves to separate in-phase $S_1$ and quadrature $S_2$ response signals. Thus an in-phase response signal $S_1$ can be relayed by the output port formed by the split side limb 241D, and the quadrature response signal $S_2$ can be relayed by the output port formed by the other split limb 241B.

Because the centre conductor 265 in connected to conductor 267 at one end (the lower end as drawn in FIG. 14) and at its other end is connected via the antenna arm 241B, which presents a low hf impedance, to conductor 263, inclusion of the centre conductor modifies the hf properties of the transmission line 261. The most important effect is to increase the matching impedance for a transmission line an electrical length of a quarter wavelength. In order to provide a good match to the mixer diodes, it is convenient to choose a transmission line impedance that is not too high. This can be achieved by making the width of the centre conductor 265 small compared with the width of the outer conductors 263 and 267, and also compared with the spacing between the three conductors 263, 265 and 267.

Figure 14:
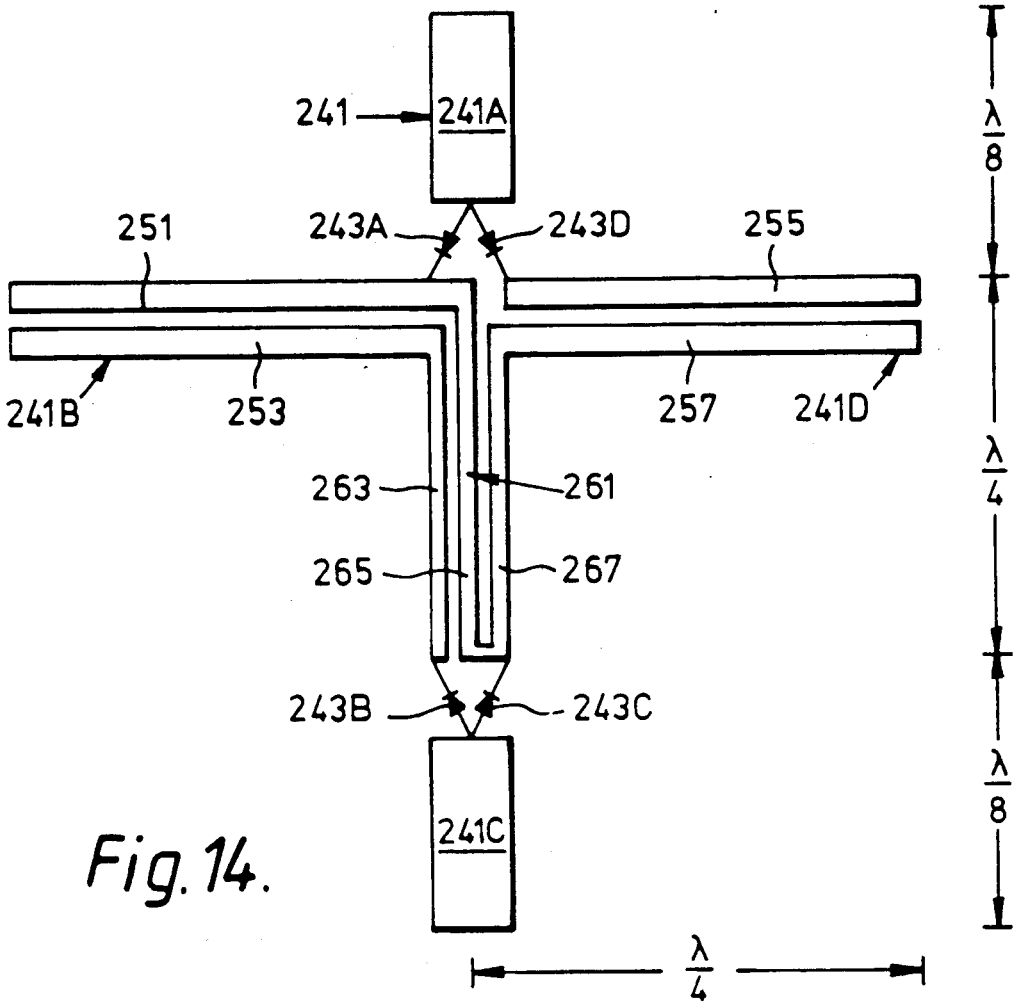
FIGS. 14 and 15 show antenna circuits arranged for coherent mixing.
Figure 11:
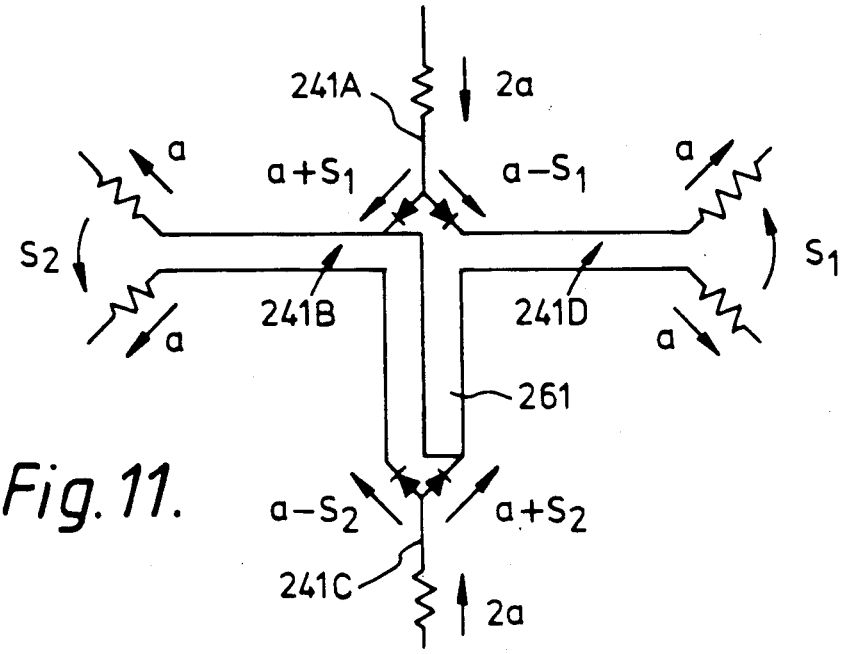

In the coherent mixer configuration shown in FIG. 14 the transverse dipole 241B–241D is located a distance $\lambda/8$ from the antenna centre. This results in a significant difference in the dipole impedances produced at the break bridged by the upper pair of diodes 243A and 243D and at the break bridged by the lower pair of diodes 243B and 243C. Greater sensor efficiency may be achieved by a straightforward modification. The impedance difference may be reduced by locating the transverse dipole 241B–241D relatively closer to the antenna center and by altering the relative dimensions of the dipole limbs 241A, 241C and of the three-line section 261. Decrease in the transverse dipole to antenna centre offset results in reduced field distortion in the vicinity of the upper pair of diodes 243A, 243D, and in consequence the impedance at the break is more nearly equal to the impedance at the lower break. Care must be taken to ensure that the desired signal phase relationships are maintained. One way of achieving correct phase relationships, is to use the sensor with a local oscillator running at an appropriate matching frequency: to illustrate this, consider the use of a local oscillator running at one half the resonant signal frequency $f_s$. An efficient coherent mixer for this application may be dimensioned as follows:

Length of transverse dipole: $\lambda_s/2$ (This dipole 241B–241D is resonant at the signal frequency $f_s$, and is aligned parallel to the plane of signal polarisation);

Length of longitudinal dipole: $\lambda_s$ (This dipole 241A–241C is resonant at the local oscillator frequency $f_S/2$ and is aligned parallel to the plane of the local oscillator radiation polarisation, a plane to the plane of signal polarisation);

Transverse dipole offset: $\lambda_S/8$;

Length of three-line section: $\lambda_S/4$.

Since the three-line section 261 is of length one-quarter of the signal resonant wavelength, the correct phase relationships are maintained.

It is possible to vary the oscillator frequency, matching length of the longitudinal dipole, and transverse dipole offset, whilst maintaining the length of the three-line section at $\lambda_S/4$, to give other efficient configurations.

Another way of achieving correct phase relationships is to load the three-line section 261 to slow the signal propagation along the section. This could be attained using discrete capacitive loading. One method for providing the capacitative loading is to overlay the metal conductors 263, 265 and 267 with strips of metal transverse to the conductors 263, 265 and 267 and separated from them by a layer of dielectric.

Figure 15:
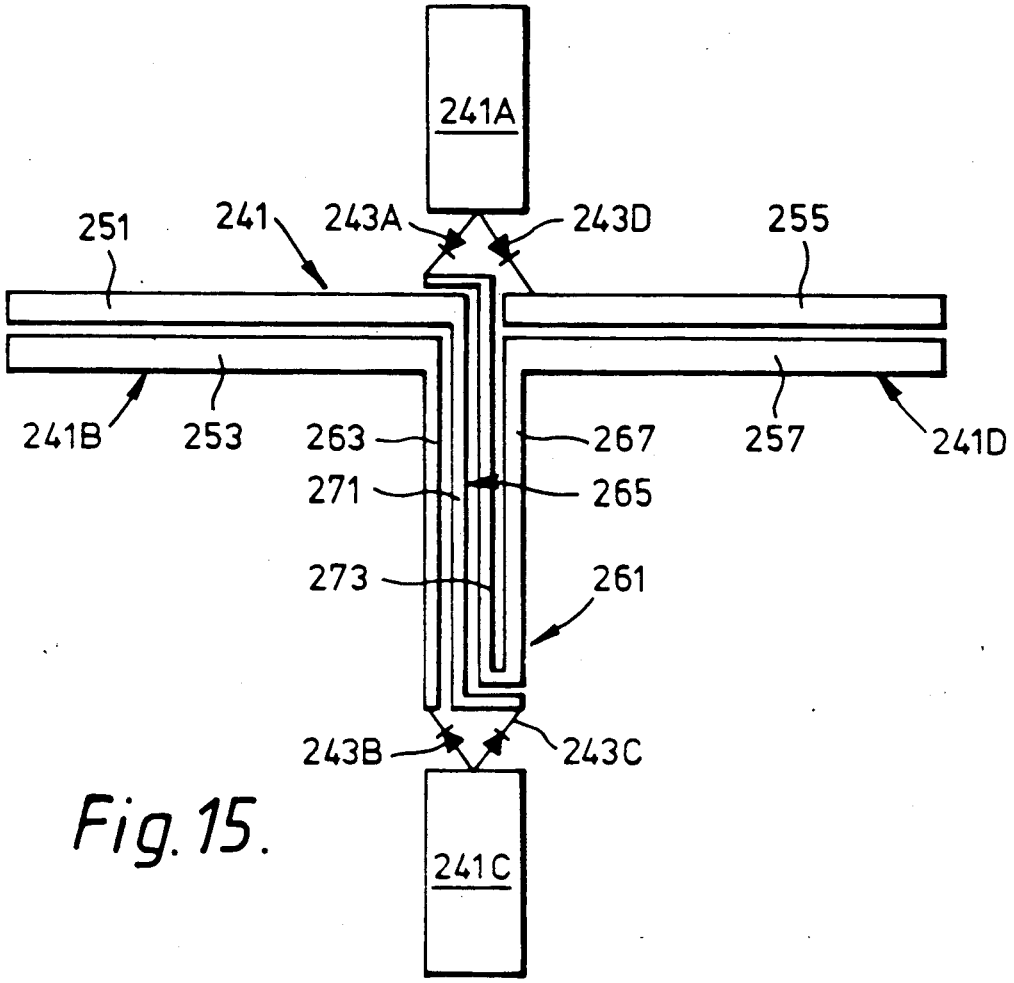

A property of the diode antenna combination illustrated in FIGS. 11 to 14 is that the low frequency ports have a common connection viz conductor 265. Port isolation can be achieved by simple modification, to allow simplification of the design of the associated low frequency amplifiers. In the modification that is shown in FIG. 15 the connecting conductor 265 is split down is entire length into two separate conductor portions 271 and 273. In doing this it is also ensured that enough capacitance is provided between the two conductor portions 271 and 273, or the capacitance is supplemented in the manner already described if necessary.

It will be noted that the polarity of each diode is shown by the conventional symbol. However the polarity of all the diodes in any one of the above examples may be reversed without altering the mixer function and often one or other choice of direction will be preferable for compatibility with the low frequency circuitry.

Figure 16:
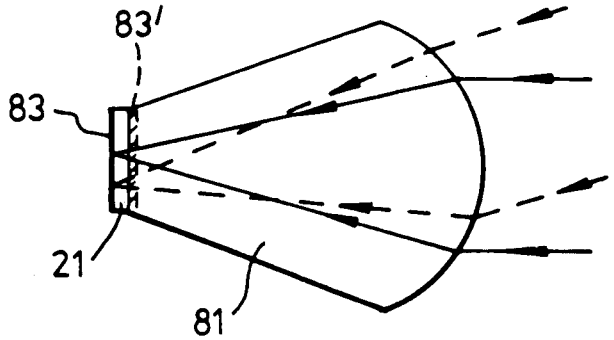
FIGS. 16 and 17 are respectively cross-sectional and plan views of a dielectric lens employed to couple radiation to an antenna array.
Figure 17:
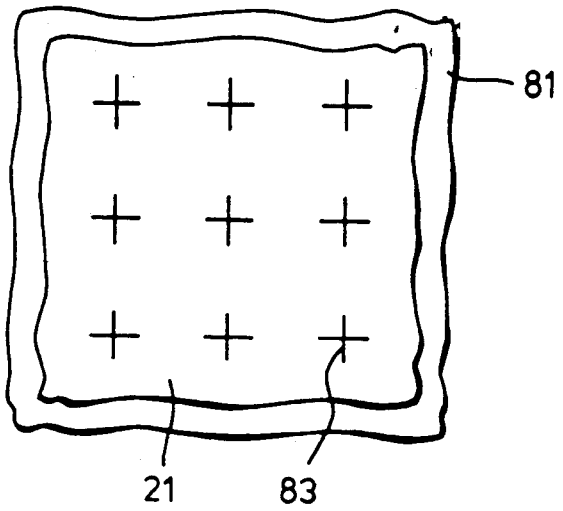

In accordance with the invention, the sensors described above and incorporating antenna arrays are each combined with a respective dielectric lens. This is shown in FIGS. 16, 17 where the silicon supporting substrate 21 is bonded to the plane back surface of a dielectric lens 81 of alumina ceramic ($\epsilon \simeq 10$). The sensors 83 are arranged in an array of the back surface of the substrate 21, and are located in the focal plan of the lens 81. Each sensor, lying in a different region of the focal plane will thus correspond to radiation incident from a different angle to the axis of the lens. Reference radiation of appropriate polarisation may be supplied by a local oscillator. This radiation can be introduced from the back of the sensor—i.e. from the air medium, where antenna coupling is weak. Alternatively the local oscillator signal may be introduced by propagation through the lens—i.e. from the dielectric/semiconductor medium where antenna coupling is strong. In this case it is necessary to locate the local oscillator near to the lens 81 so that the reference radiation can be coupled to all the sensors 83 of the array. It is an advantage that the sensors 83 are located on the back surface of the substrate/lens combination, for here they are readily accessible and conventional bonds can be made to the associated low frequency circuits.

Another method for illuminating the receiver antennae with local oscillator power is to radiate power into the dielectric lens using a transmission antenna at some point on its surface so that radiation internally reflected at the surface of the lens falls on to the semiconductor chip supporting the antennae.

Alternatively, the internal reflection could take place on a mirror surface constructed inside lens, e.g. by a grid of metal wires aligned parallel to the polarisation of the radiation the mirror is required to reflect. The metal wire grid will transmit the orthogonal polarisation, which is convenient for separating the paths taken by local oscillator and signal radiation.

A useful sensor spacing across the array is that which corresponds to the resolution of the lens given by the Rayleigh criterion according to which the resolved spot separation is roughly $1.2\ F\ \lambda/n$. Here F is the lens F-number i.e. ratio of focal length to diameter of the lens (chosen to be close to 0.7 in the present case), $\lambda$ is the free space wavelength, and n is the refractive index of the dielectric. At a frequency of 100 GHz, the resolved spot separation is about 800 $\mu$m for a dielectric having dielectric constant $\epsilon \simeq 10$ approximately matched to silicon ($\epsilon \simeq 11.7$). Thus the sensors can be arranged 800 $\mu$m from centre to centre to match this resolution, each sensor occupying a cell approximately 600 $\mu$m square. This arrangement of lens and sensor array is advantageous, for it allows collection of signal radiation in the different resolved beams of the lens at the same time.

The sensor array also permits comparison of signals received simultaneously from different directions in order to construct a picture of the reflecting object. The bonded array may then be situated at a distance from the focal plane so that incident radiation from a chosen direction couples to several or all of these sensor. It is then possible to construct the far field pattern by combining sensor signals during subsequent signal processing. In this way, higher angular resolution then that given by the Rayleigh criterion can be achieved.

The dielectric constant of the lens material is a major factor determining the resonant length of an antenna for a given frequency. As long as the semiconductor body is very much thinner than the wavelength in the semiconductor, the antenna resonant frequency and impedance will be chiefly determined by the dielectric constant of the lens rather than that of the semiconductor. An alternative to the use of a lens material with dielectric constant close to that of the semiconductor is to use a lens material with a higher or lower dielectric constant. With a higher dielectric constant the antenna length and resolved spot size are reduced by a factor approximately equal to $\sqrt{(\epsilon_1/\epsilon_S)}$ where $\epsilon_1$ is the lens dielectric constant and $\epsilon_S$ is the semiconductor dielectric constant. This can be convenient for reducing the size of a receiver or of a receiver array for lower frequencies where the wavelength in the semiconductor would lead to an inconveniently large circuit size. This choice of lens dielectric constant is therefore most suited to frequencies below about 60 GHz. One suitable material for the lens is barium nonatitanate ($Ba_2Ti_9O_{20}$) ceramic which has a dielectric constant close to 39 and which reduces the resonant length of antenna and the resolved spot dimension by a factor of about 2 compared with a lens made from alumina ceramic.

Use of a lower dielectric constant material such as silica or PTFE increases the antenna resonant length and resolved spot size and this may be convenient when the required circuit dimensions would otherwise be inconveniently low such as for frequencies over 250 GHz. There is now a potential problem in that radiation could be trapped in the semiconductor body because its dielectric constant is higher than that of the media either side. This could cause undesirable coupling between antennae. The problem may be reduce by thinning the semiconductor body, or by increasing its conductivity to increase the tapped wave losses or by doing both.

It is not necessary for the lens to be made from a homogeneous material. The antenna and receiver sizes are determined by the dielectric constant of the lens material adjacent to the semiconductor body. Outer layers of the lens may be made from other materials without significant effects on the antenna resonance, but such outer layers will alter the focal length and the far field lens pattern in the same way as multiple layer lenses are used at visible light wavelengths (e.g. in cameras). A multiple layer lens may therefore be used to modify the field of view of a sensor array.

An alternative approach to the above, one particularly suited to lower frequency (longer wavelength) applications, is to mount the array of antennas, 83' between the semiconductor substrate 21 and a lens 81 of significantly higher dielectric constant material. In this case the antenna radiation pattern and resonance are strongly dependent upon the dielectric properties of the lens 81 (see FIG. 16). Each sensor is in this case predominantly sensitive to radiation incident from the lens side of the antenna. The semiconductor substrate 21 here serves only to integrate the mixer diodes and other circuit components, whilst the lens 81 serves as the radiation propagating medium.

Overload Protection

Figure 18:
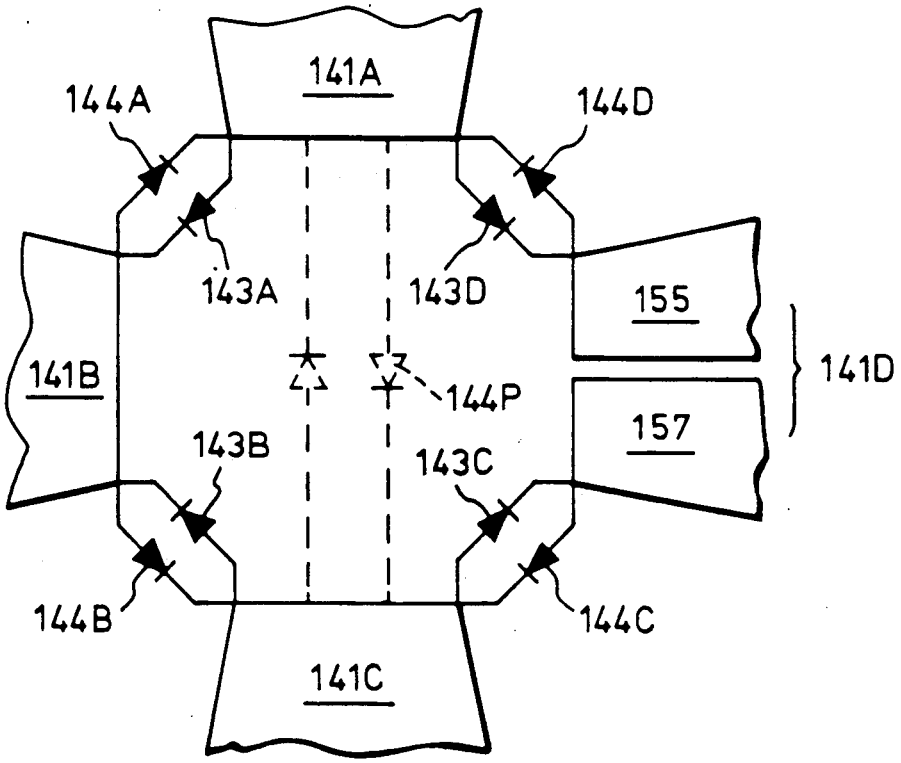
FIGS. 18 and 19 illustrate the use of limiter diodes in a balanced mixer.

The diode ring sensors shown in FIGS. 8, 9, 10, 14 and 15 may be modified readily to protect the sensor circuitry against damage by high power radiation incident on the sensor optics. One approach is to shunt each mixer diode with a limiter element, eg a Schottky or PIN diode. This approach is illustrated in FIG. 18. Each of the mixer diodes 143A to 143D is shunted by a Schottky diode 144A to 144D. Each limiter diode—e.g. 144A, is arranged anti-parallel—ie head-to-tail, and tail-to-head, with the corresponding mixer diode—e.g. 143A. Under normal conditions, when signal levels are low, each limiter diode is reverse biased, being in a low current, high impedance state, Under overload conditions, however, each limiter conducts strongly and has a low impedance. This limits the voltages developed across the mixer diodes. When the radiation level is reduced, the limiter diodes revert to their normal state. In this case, overhead protection is provided irrespective of the polarisation of the incident radiation.

Another approach is to connect one or more limiter pairs—e.g. a pair of anti-parallel Schottky diodes, or a Schottky diode and an anti-parallel PIN diode—between the opposite limbs of one of the crossed dipoles of the antenna. In this case, in FIG. 18, the limiter diodes 144A to 144D are replaced by a limiter pair 144P connected between the dipole limbs 141A and 141C of the antenna 141. However, in this arrangement, overload protection is provided for one polarisation of radiation only, the polarisation parallel to the bridged dipole 141A-141C. Under normal conditions, i.e. in low signal operation, the voltage appearing across the limiter pair is very low, irrespective of the magnitude of the local oscillator radiation, radiation polarised parallel to the orthogonal dipole 141B-141D, so a high impedance state for the diode pair is achieved readily.

Figure 19:
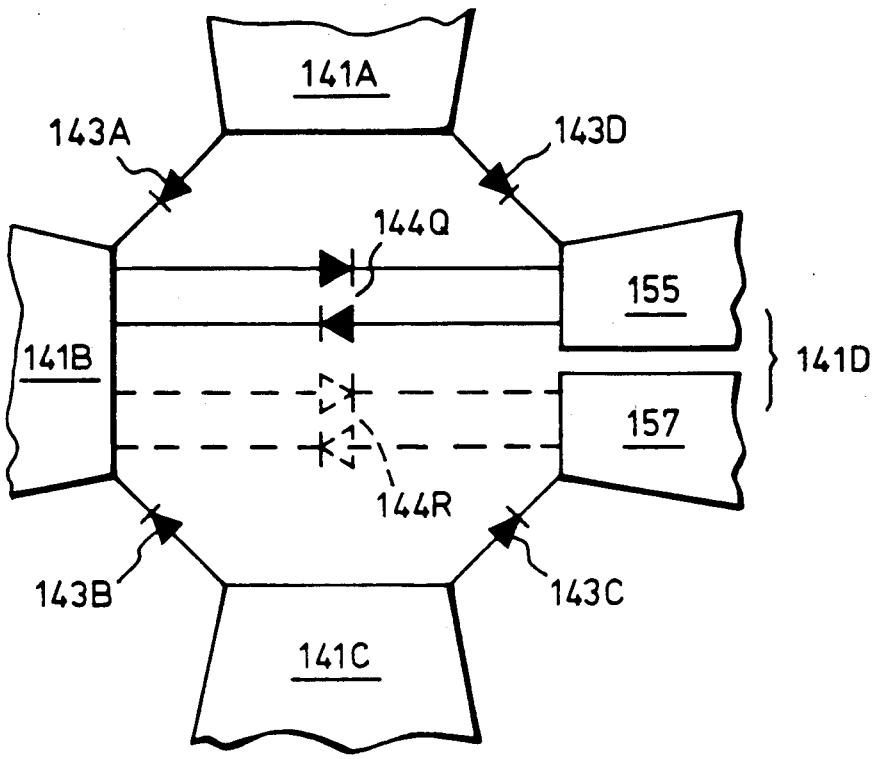

In FIG. 19, two limiter pairs 144Q, 144R are used to provide overload protection against signal radiation polarised parallel to the other dipole, dipole 141B-141C. Each limiter pair 144Q, 144R is connected between one limb 141B and one of the split portions 155, 157 of the other limb 141D. Provided the capacitance between the split portions 155 and 157 can be made large enough so that high frequency voltages between the two limb portions are always low, one of the limiter pairs 144Q or 144R may be omitted.

The optical system can be designed to prevent incident signal radiation polarised parallel to that from the local oscillator from reaching each antenna. One way of doing this is to incorporate a polarisation selective filter comprising an array of conductive stripes. This filter has the property of reflecting radiation with its electric field (E-vector) parallel to the strips whilst passing radiation of orthogonal polarisation.

The bias circuits may also be modified to provide a degree of overload protection, and this may be used as an alternative to, or in combination with the inclusion of limiters. Both the conversion loss and the high frequency overload power of the diodes are dependent of bias level. The bias control circuits may be designed to increase forward bias level wherever high incident power is sensed, to protect the sensor circuits and diodes.

The sensor or sensor arrays described hereinbefore may be combined with a local oscillator to provide a radiometer for sensing natural emissions, or an anti-radiation detector for detecting manmade emissions. Alternatively, they may be combined with a local oscillator and a transmitter (local, or remote), to provide a radar or communications system.

Figure 20:
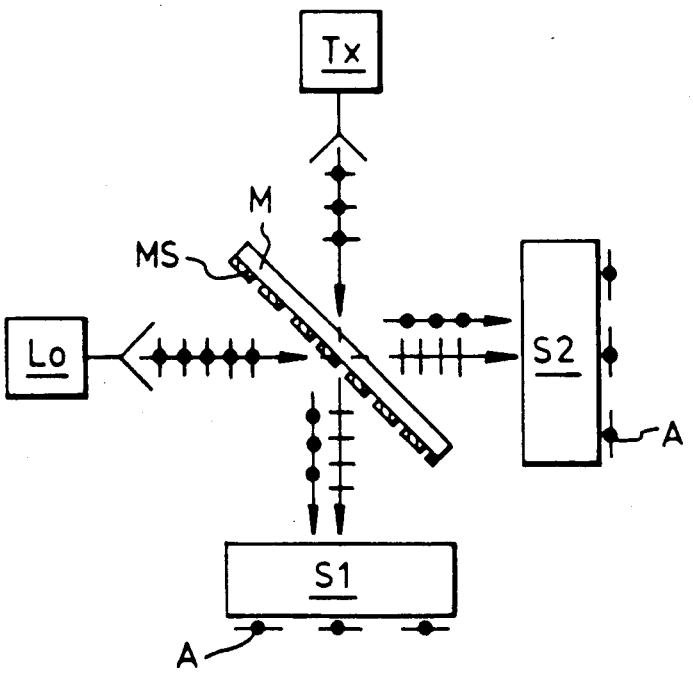
FIG. 20 is an elevation view of a receiver system including two antenna arrays.

FIG. 20 illustrates a system incorporating two biased sensor arrays S1, S2 used for resolving the different polarisation components of a signal emission, for example the emission from a remote transmitter Tx. The system optics includes a polarisation sensitive mirror filter M, inclined to the antenna array planes of the two sensor array S1, S2. This mirror M comprises a grid of parallel metal stripes MS, and the mirror M is arranged with these stripes MS parallel or orthogonal to the antenna dipoles A. This mirror has the property of reflecting radiation polarised parallel to the stripes MS whilst transmitting radiation of orthogonal polarisation.

The system includes a local oscillator LO arranged relative to the mirror M to illuminate the two sensor arrays, S1, S2 with reference radiation of a resonant frequency. The mirror M serves to separate the orthogonal components of the reference radiation, and the polarisation of the reference radiation which may be circular, elliptic or linear, is arranged so that the reflected and transmitted beams are of equal amplitude. The mirror M also serves to separate the orthogonal polarisation components of the signal radiation. The transmitted beam and the reflected beam incident on each sensor array, are of orthogonal polarisation, as shown. This system which may be assembled compactly, thus enables simultaneous resolution of the signal radiation.

Figure 21:
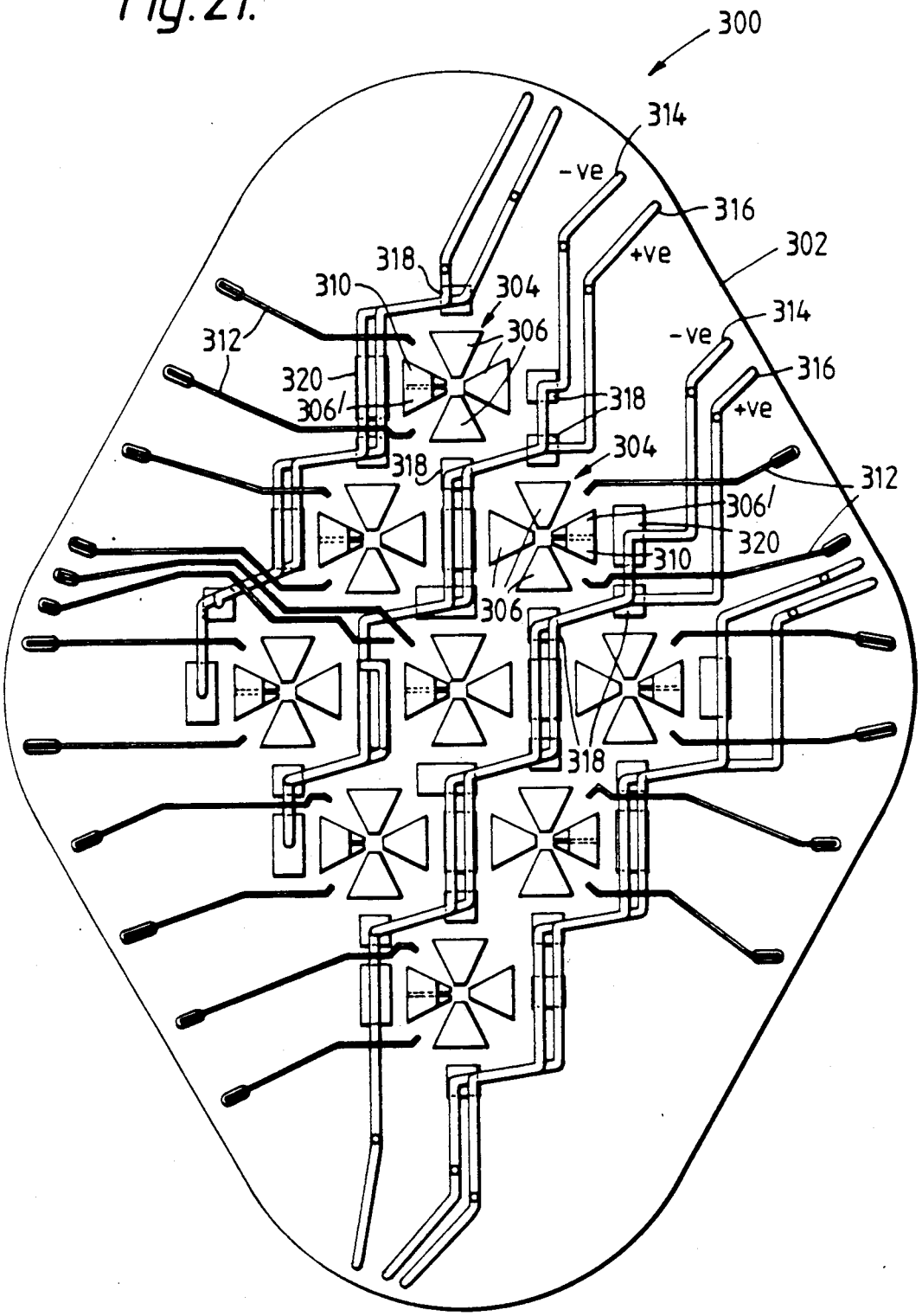
FIG. 21 is a plan view of a substrate for a sensor of the invention, the substrate being shown with metallised parts only and approximately ten times actual size.
Figure 22:
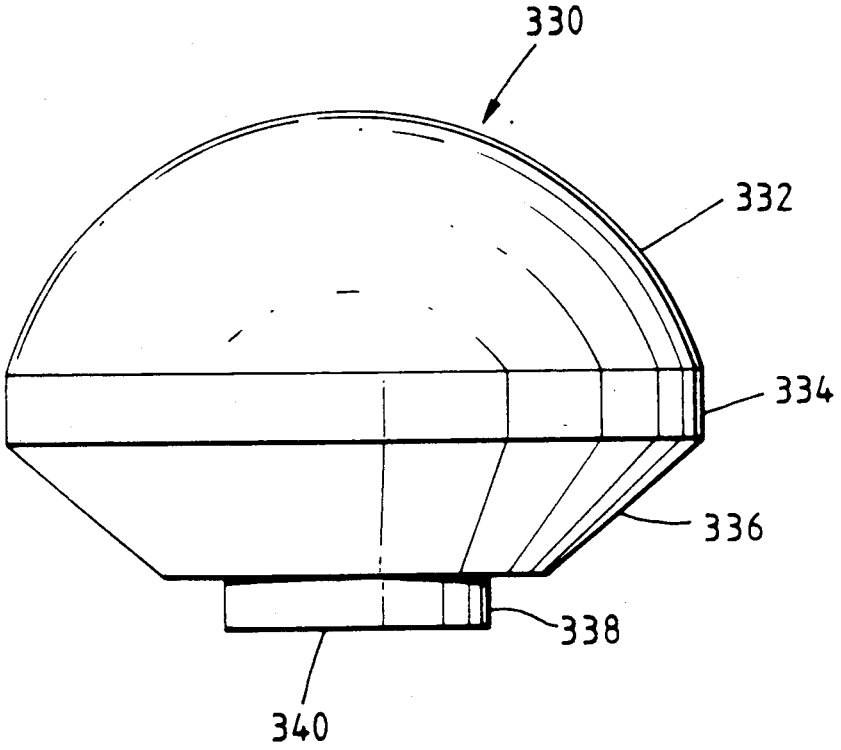
FIG. 22 is a cross-sectional view of a dielectric lens for use with the FIG. 21 substrate.
Figure 1:
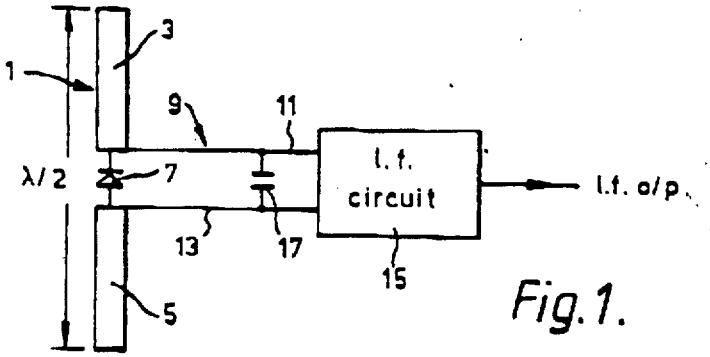
Figure 2:
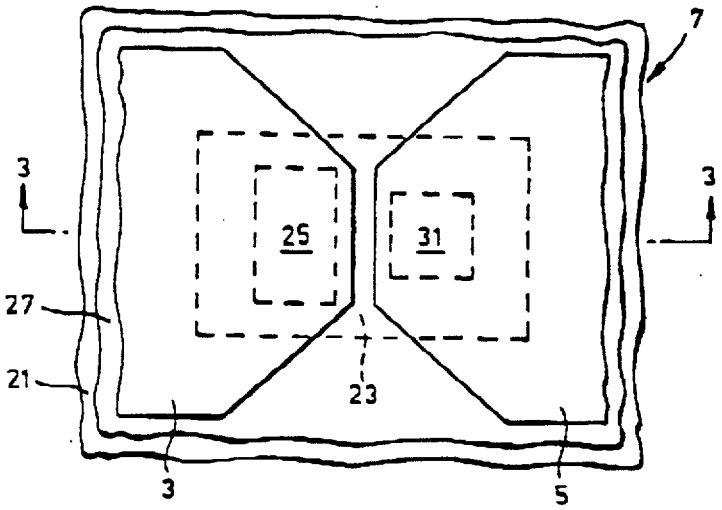
Figure 3:
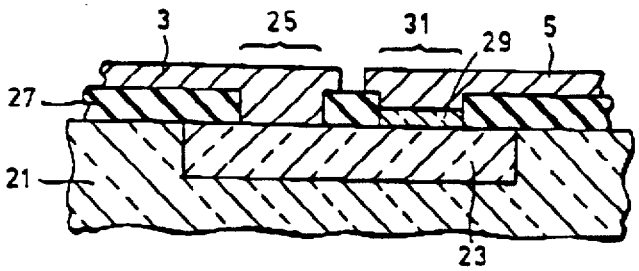
Figure 9:
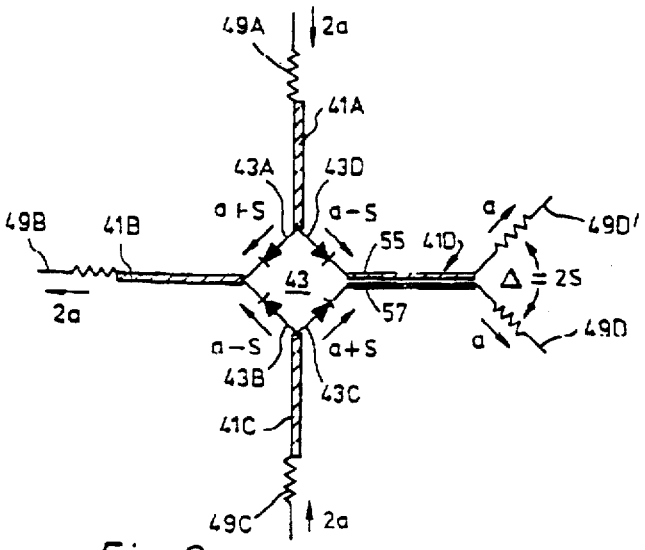
Figure 10:
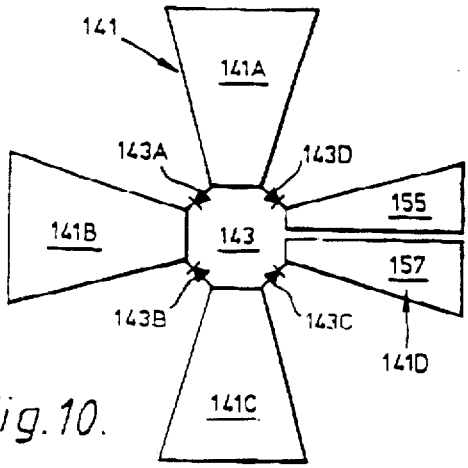

Referring now to FIGS. 21 and 22, a further sensor of the invention is illustrated in greater detail. FIG. 21 is a plan view of a thick film hybrid antenna array circuit indicated generally by 300, and shown on a scale which is approximately ten times actual size. The circuit 300 is illustrated with plated metal features only to reduce drawing complexity, bond wires, mixer diodes and resistors not being shown. The circuit 300 is formed on a substrate 302 in the form of an alumina sheet. Nine antennas such as 304 are formed as metallisation layers on the substrate 302, and are arranged in a rhombus configuration. Each antenna 304 consists of two crossed bow-tie dipoles each with two limbs such as 306, one limb 306' of the four limbs of each antenna is split to form a capacitive low frequency open circuit for extracting IF mixer output signals. FIG. 10 shows an antenna 141 equivalent of each of the antennas 304 on a larger scale. Each antenna 304 incorporates a ring of high frequency mixer diodes (not shown) connected as illustrated in FIG. 10; i.e. each mixer diode is a discrete high frequency component bonded between a respective pair of adjacent limbs of different dipoles. Each split limb 306' is overlaid successively by an insulating layer (not shown) and a metal layer 310 providing a capacitor in combination with the limb. The capacitor acts as a high frequency short circuit, so that each split limb 306' is electrically continuous at this frequency. The metal layer 310 is substantially ineffective at the much lower mixer output signal frequencies.

Each antenna 304 is associated with a respective pair of low frequency output signal lines 312, of which one is capacitively connected to earth when in use. Each pair of line 312 is connected to a respective split antenna limb 306' by bond wires (not shown), each line 312 being associated with a respective limb division. The mixer diodes (see FIG. 10) receive DC bias voltages via bias conductors 314 and 316, of which there are four of each. Where the conductors 314 and 316 overlap one another or lines 312 they are insulated by intervening layers (not shown). The bias conductors 314 and 316 are connected to the antennas via bias resistors (not shown) equivalent to resistors 49A to 49D' in FIG. 9. The resistor are microwave chips which are mounted on and electrically connected to respective metal layers indicated by squares 318 and rectangles 320. The bias conductors 314 supply negative DC bias to both limbs (of which one is divided) of the horizontal dipole of each antenna 304. The bias conductors 316 supply positive DC bias to both limbs of the vertical dipole of each antenna 304. The DC bias current through each mixer diode is set to an appropriate value for good mixer conversion efficiency.

In operation of the circuit 300, pairs of low frequency output signal lines 312 are connected to respective amplifiers (not shown). Such amplifier may be located on the circuit substrate, and where convenient adjacent respective antennas, in other embodiments of the invention. The circuit 300 is suitable for detecting at radar frequencies in the range 30–40 GHz.

Referring now also to FIG. 22, a solid dielectric lens 330 for use with the circuit 300 is shown in cross-section. The lens 330 is of alumina, and is illustrated to a scale which-approximates to actual size. It has a spherical surface region 332, a short first cylindrical region 334, a frusto-conical region 336 and a relatively narrow radius second cylindrical region 338. The second cylindrical region 338 has a flat surface 340 (shown side-on) for receiving the antenna circuit 300.

In use, the circuit 300 and lens 330 are assembled together so that the antennas 304 are on the substrate surface remote from the lens. The substrate 302 is arranged flat against the face 340 of the second cylindrical region 338 of the lens 330. The arrangement is similar to that shown in FIG. 16 with antennas located as at 83. The substrate 302 and lens 330 are both of alumina, and the substrate acts as an extension of the lens for the purposes of transmitting high frequency radiation to the antennas 304.

The embodiment, illustrated in FIG. 21 and 22 demonstrates that the invention can be manufactured for use in the region of 35 GHz employing mature technology suitable for mass production at low cost. The antenna circuit 300 is a thick film hybrid of the kind which is well-known in the electronic manufacturing art. The lens 330 presents no production difficulty, since the engineering of ceramic components is also well-known.

I claim:

1. An electromagnetic radiation sensor of modular construction including:

(a) a substrate module in the form of a sheet and retaining:

(i) an array of antennas each having at least two dipole limbs supported by a substrate sheet surface, (ii) a respective mixing means for each antenna, the mixing means comprising at least one high frequency mixer diode connected between two antenna limbs, (iii) means for relaying low frequency signals developed by the mixing means to sensor outputs, (b) a dielectric lens module assembled together with and closely adjacent to the substrate to transmit radiation incident on the lens to the antenna array, the lens being configured such that the antenna center positions in the array correspond to differing beam directions for radiation incident on the lens, and the lens-antenna array spacing and the lens and substrate dimensions and dielectric properties being in combination such as to provide for each antenna to couple predominantly to radiation passing through the lens.

2. A sensor according to claim 1 wherein the spacing of neigbouring antenna centres in the array is substantially equal to the Rayleigh resolved spot separation defined by the lens F-number and dielectric constant together with the sensor operating wavelength, and where the antenna array is located within the depth of focus of the lens so that each antenna is disposed to receive a respective radiation beam.

3. A senor according to claim 1 wherein the lens is arranged to couple radiation to the antenna array through the substrate thickness, the lens and substrate having dielectric constants with similar values.

4. A sensor according to claim 3 wherein the substrate, antenna array, mixing means and low frequency relaying means are formed in combination as an integrated circuit.

5. A sensor according to claim 4 including a low frequency amplifier integrated in the substrate and arranged to amplify signals received via the low frequency relaying means.

6. A sensor according to claim 1 wherein t he lens has a lower dielectric constant than that of the substrate and is arranged to couple radiation to the antenna array through the substrate thickness, and the substrate conductivity and thickness are arranged in combination to inhibit radiation trapping.

7. A sensor according to claim 1 wherein the lens has a dielectric constant larger than that of the substrate and the antenna array is sandwiched between the lens and substrate.

8. A sensor according to claim 1 including means for relaying a local oscillator signal to each antenna of the array.

9. A sensor according to claim 1 wherein each antenna dipole is crossed by a second-two-limb dipole having at least one longitudinally divided limb providing the said low frequency output signal relaying means.

10. A sensor according to claim 9 wherein the mixing means comprises mixer diodes connected between adjacent limbs of different dipoles, the diodes being arranged to provide any one of balanced mixing and coherent mixing.

11. A sensor according to claim 10 including respective limiter diodes shunting respective mixer diodes.

12. A sensor according to claim 10 wherein each dipole antenna includes a respective transmission line section connecting pairs of mixer diodes.

* * * * *

UNITED STATES PATENT AND TRADEMARK OFFICE

CERTIFICATE OF CORRECTION

PATENT NO. : 5,030,962

DATED : July 9, 1991

INVENTOR(S) : REES

It is certified that error appears in the above-identified patent and that said Letters Patent is hereby corrected as shown below:

On the title page,

IN THE ABSTRACT:

Line 15, correct the spelling of --substrate--.

IN THE FIGURES:

Please replace Fig. 9 and Fig. 10 with the attached corrected sheets of drawings.

Column 3, line 14, change "may" to --many--;

Column 5, line 44, correct the spelling of --center--.

Column 5, lines 54 and 55, correct the spelling of --neighboring--;

line 56, after "angular" insert --region--.

Column 8, line 44, change "X-X" to --3-3--.

Column 9, line 38, delete "to".

Column 10, line 7, change "top" to --stop--.

UNITED STATES PATENT AND TRADEMARK OFFICE

CERTIFICATE OF CORRECTION

PATENT NO. : 5,030,962

DATED : July 9, 1991

INVENTOR(S) : REES

It is certified that error appears in the above-identified patent and that said Letters Patent is hereby corrected as shown below:

Column 13, line 1, correct the spelling of --center--;

lines 43/44 and 50, correct the spelling of --polarization--;

line 65, correct the spelling of --center--.

Column 14, lines 1, 8, 14 and 25, correct the spelling of --center--.

Column 15, lines 26 and 48, correct the spelling of --polarization--;

line 64, both occurrences, correct the spelling of --center--.

Column 17, line 53, correct the spelling of --polarized--;

lines 55 and 59, correct the spelling of --polarization--.

Column 18, lines 10, 12, 19, 25, 29, and 31, correct the spelling of --polarization--;

line 18, correct the spelling of --polarized--.

UNITED STATES PATENT AND TRADEMARK OFFICE

CERTIFICATE OF CORRECTION

PATENT NO. : 5,030,962

DATED : July 9, 1991

INVENTOR(S) : REES

It is certified that error appears in the above-identified patent and that said Letters Patent is hereby corrected as shown below:

Column 20, line 17, Claim 2, correct the spelling of --neighboring--and --centers--.

Column 20, line 24, Claim 3, correct the spelling of --sensor--.

Column 20, line 36, Claim 6, change "t he" to --the--.

UNITED STATES PATENT AND TRADEMARK OFFICE

CERTIFICATE OF CORRECTION

PATENT NO. : 5,030,962

DATED : July 9, 1991

INVENTOR(S) : REES

It is certified that error appears in the above-identified patent and that said Letters Patent is hereby corrected as shown below:

Column 20, line 50, Claim 9, change "second-two-limb" to --second two-limb--.

Signed and Sealed this

Second Day of November, 1993

*Attest:*

*Attesting Officer*

BRUCE LEHMAN

*Commissioner of Patents and Trademarks*